US011084695B2

(12) United States Patent
Holman et al.

(10) Patent No.: US 11,084,695 B2
(45) Date of Patent: Aug. 10, 2021

(54) METHODS AND APPARATUS FOR IMPROVED ADJUSTMENT OF PARTITIONS

(71) Applicants: Jonathan M. Holman, Jacksonville, FL (US); Robert Trescot, Jacksonville, FL (US)

(72) Inventors: Jonathan M. Holman, Jacksonville, FL (US); Robert Trescot, Jacksonville, FL (US)

( * ) Notice: Subject to any disclaimer, the term of this patent is extended or adjusted under 35 U.S.C. 154(b) by 70 days.

(21) Appl. No.: 16/458,794

(22) Filed: Jul. 1, 2019

(65) Prior Publication Data

US 2020/0002142 A1 Jan. 2, 2020

Related U.S. Application Data

(60) Provisional application No. 62/691,781, filed on Jun. 29, 2018.

(51) Int. Cl.
*B66F 5/02* (2006.01)

(52) U.S. Cl.
CPC ..... *B66F 5/02* (2013.01); *B66F 2700/09* (2013.01)

(58) Field of Classification Search
CPC ..... B66F 5/01; B66F 5/04; B66F 3/24; B66F 3/42
See application file for complete search history.

(56) References Cited

U.S. PATENT DOCUMENTS

| | | | | |
|---|---|---|---|---|
| 4,793,592 | A * | 12/1988 | Green | B66F 3/24 254/134 |
| 7,401,392 | B1 * | 7/2008 | Ramsey | B66F 3/42 254/2 B |
| 8,166,677 | B1 * | 5/2012 | Woyak | E01H 5/02 37/265 |
| 9,751,736 | B1 * | 9/2017 | Fortin | B66F 7/243 |
| 2002/0171189 | A1 * | 11/2002 | Griggs | B66F 3/24 269/37 |
| 2003/0034483 | A1 * | 2/2003 | Anderson | B66F 5/04 254/7 B |

* cited by examiner

*Primary Examiner* — Lee D Wilson
*Assistant Examiner* — Seahee Hong
(74) *Attorney, Agent, or Firm* — Rogers Towers, P.A.; Joseph P. Kincart

(57) ABSTRACT

Method and apparatus for improved height adjustment of wall partitions. According to the present disclosure, an extendable Foot Controlled Elevator Device is placed beneath a wall partition. A user may then apply downward force on a Vertical Height Control to adjust the vertical position of the wall partition. In some embodiments, the Foot Controlled Elevator Device has a compressible base, allowing it to fit into tight areas (e.g., between toilets in a restroom under construction). In other embodiments, one or more Foot Controlled Elevator Devices may be linked, allowing for better control over the wall divider and simultaneous or distinct control of the respective Foot Controlled Elevator Devices.

11 Claims, 11 Drawing Sheets

700

METHODS AND APPARATUS FOR IMPROVED ADJUSTMENT OF PARTITIONS

CROSS REFERENCE TO RELATED APPLICATIONS

The present application claims priority to Provisional Patent Application Ser. No. 62/691,781 filed Jun. 29, 2018, entitled METHODS AND APPARATUS FOR IMPROVED ADJUSTMENT OF PARTITIONS.

FIELD OF THE DISCLOSURE

The present disclosure relates to methods and apparatus for improved adjustment of partitions.

BACKGROUND OF THE DISCLOSURE

Wall partitions are used around the world as a means for dividing rooms. The classic application of a wall partition is the stall dividers in a restroom, other uses are also common.

Stall dividers generally do not rest on the floor of the restroom. Accordingly, to install a stall divider, a mechanic may wish to have at least the stall divider itself, one or more brackets, one or more pilasters, and a door. The stall divider rests on a bracket mounted to the wall, and a bracket mounted to the pilaster.

Once a mechanic has mounted the stall divider to these brackets, it can be very difficult to adjust the height of the divider. Examples of previous methods known in the art to adjust the height of the divider include positioning a rigid object underneath the divider and applying leverage to lift the divider. However, this method has the potential to damage the divider or the wall, and is difficult for a single mechanic or other user to execute. The price of a divider can range from $500-$1500; labor costs for multiple personnel are significant and the damage to a user's back can be unquantifiable. Thus, the existing method may be very costly.

Similarly, while basic jacks are, of course, known in the art, they may be difficult to position when installing restroom partitions. Typically, partitions are installed only after the toilets are installed. Known tools may have some difficulty in navigating the usual small amount of space between installed toilets.

SUMMARY OF THE DISCLOSURE

Accordingly, the present invention provides methods and an apparatus for improved adjustment of partitions that provides consistent, efficient and more simple installation and may reduce a potential of installation mistakes or injuries to installation personnel.

The present invention utilizes a Foot Controlled Elevator Device to simply and safely raise the height of a partition or other building component. Throughout the present disclosure, restroom stall dividers will be cited as a chief example, but the present disclosure is not limited to such a narrow subset of dividers. For example, the present disclosure may also be useful in one or more of: cabinet installation; decorative panels; sheet rock; hardy board; prefabricated paneling and the like.

And, a plurality of Foot Controlled Elevator Devices may be linked to allow for simultaneous lifting of the partition from a plurality of fulcra. The Foot Controlled Elevator Devices may rise in tandem or separately, to achieve the desired horizontal leveling of the partition.

BRIEF DESCRIPTION OF THE DRAWINGS

The accompanying drawings, which are incorporated in and constitute a part of this specification, illustrate several embodiments of the disclosure and, together with the description, serve to explain the principles of the disclosure.

DETAILED DESCRIPTION

The present disclosure provides generally for a method and apparatus for improved adjustment of partitions. According to the present disclosure, a Foot Controlled Elevator Device is inserted beneath a partition. By applying downward force from a user's foot against a Vertical Height Control, the Foot Controlled Elevator Device rises up to increase the height of the partition.

In the following sections, detailed descriptions of examples and methods of the disclosure will be given. The description of both preferred and alternative examples though through are exemplary only, and it is understood that to those skilled in the art that variations, modifications, and alterations may be apparent. It is therefore to be understood that the examples do not limit the broadness of the aspects of the underlying disclosure as defined by the claims.

Figure 1:
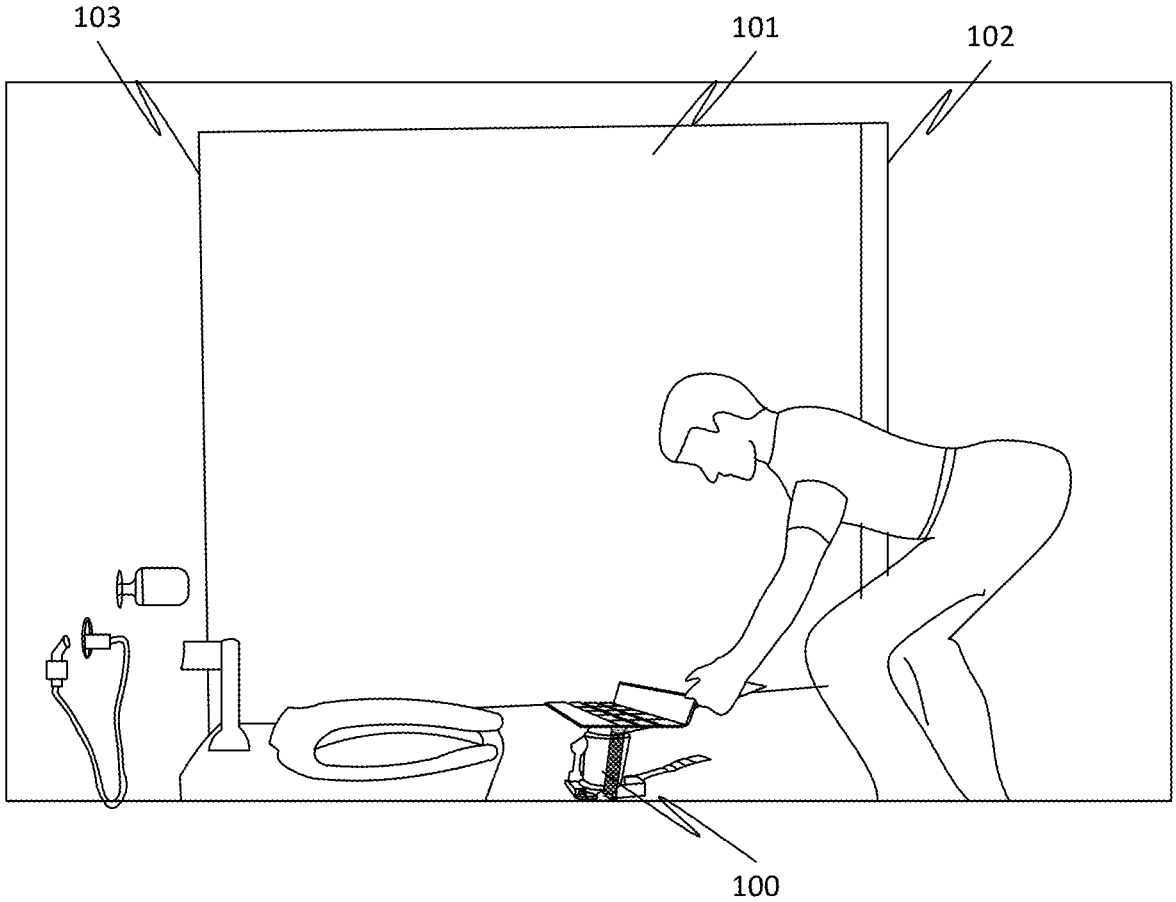
FIG. 1 illustrates an exemplary embodiment of the Foot Controlled Elevator Device as applied to a partition.

Referring now to FIG. 1, an exemplary embodiment of the apparatus is shown. The Foot Controlled Elevator Device 100 sits on the ground underneath a Divider Panel 101. In some embodiments, the Divider Panel 101 may comprise a stall divider, a partition, a room divider, or an art panel. Additional uses may also include, for example, positioning of a wall material during installation, such as a gypsum board, sheetrock, and hardy board. The Divider Panel sits at least several inches off the ground and may be supported by a Wall Support 103 and a Vertical Support 102, positioned at the distal end of the Divider Panel 101. The Wall Support 103 may comprise a bracket or a channel. The Vertical Support 102 may comprise a post, column, doorway, pilaster, or stanchion. The Foot Controlled Elevator Device 100 provides upward force in a direction roughly parallel to the Wall Support 103 and Vertical Support 102, to minimize undesirable impacts to the positions of the Wall Support 103 and Vertical Support 102.

Figure 2:
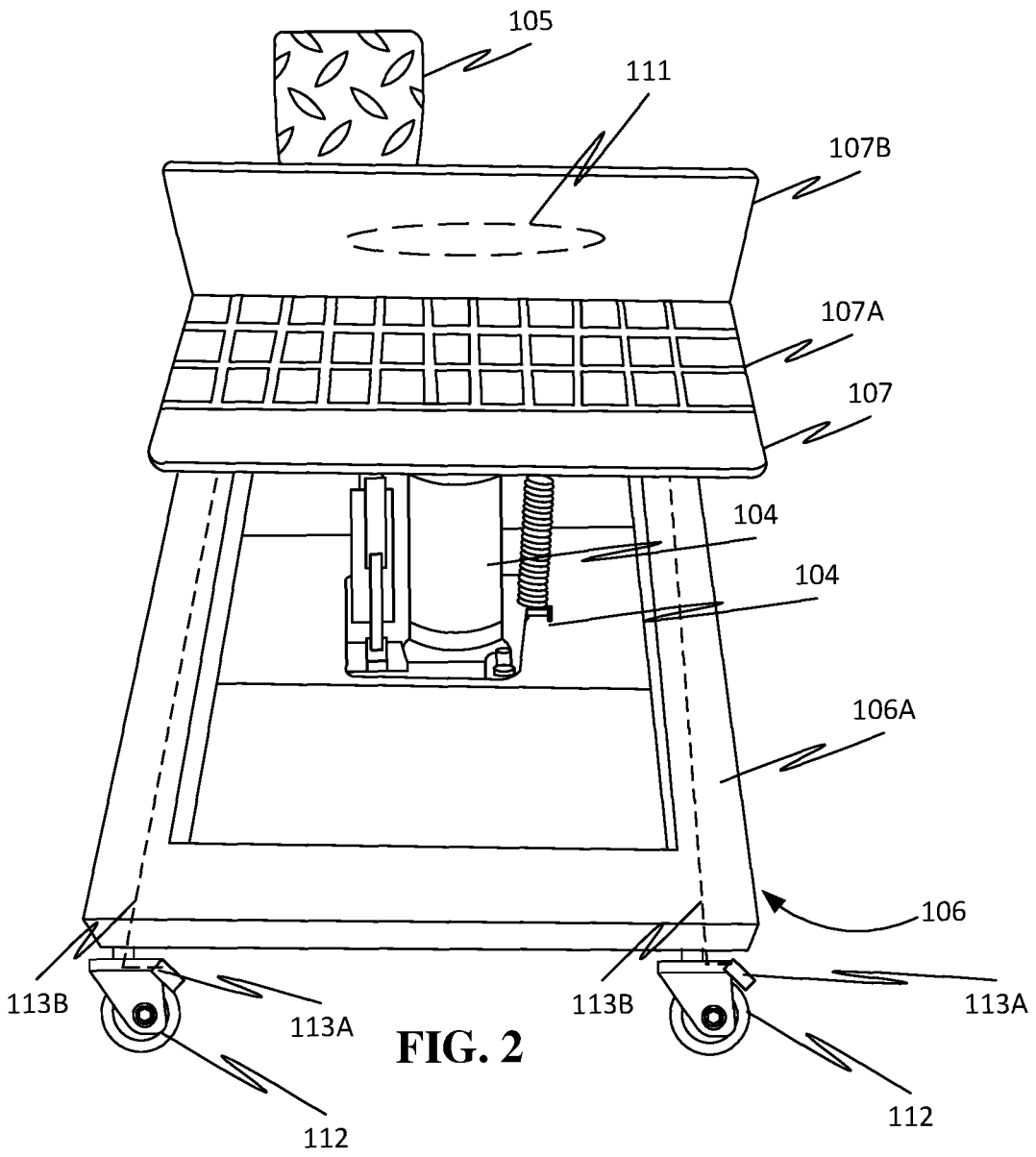
FIG. 2 illustrates a front view of an exemplary embodiment of the Foot Controlled Elevator Device.

Referring now to FIG. 2, a front view of an exemplary embodiment of the Foot Controlled Elevator Device 100 is shown. The Foot Controlled Elevator Device 100 comprises a Vertical Height Actuator 104, Vertical Height Control 105, Stabilization Base 106, and Saddle 107. In some embodiments, the Stabilization Base 106 is shaped like a rectangular prism with a height relatively small compared to the gap between the base of the Divider Panel 101 and the ground. In some embodiments, the Stabilization Base 106 may be arcuate, oval-shaped, or round. The Stabilization Base 106 comprises a Perimeter Frame 106*a*, to surround the Stabilization Base 106, and a Center Support Platform 106*b*, to support the upward movement of the Vertical Height Actuator 104. The Stabilization Base 106 may help prevent tipping of the Foot Controlled Elevator Device 100 and provides firm contact with the floor. In some embodiments, the Stabilization Base 106 may further comprise two wheels 112 and stands. In other embodiments, the Stabilization Base 106 may further comprise four wheels 112, and in some embodiments, those wheels have locks. In embodiments, in which the Stabilization Base 106 further comprises wheels, these wheels may drop to be roughly flush with the floor when the Vertical Height Control 105 is engaged. In some embodiments, the Stabilization Base 106 may have anti-skid characteristics, such as a high-friction Center Support Platform 106*b* or wheels with a built-in brake system. The brake system may be executed by pads 113A, which may be actuated using brake lines 113B. Brake lines 113B may connect to any appropriate activation mechanism, such as Vertical Height Control 105. In some embodiments, the Stabilization Base 106 may comprise a scissor structure, such that the legs spread out to maximize support while raising the Divider Panel 101. These embodiments are particularly useful where the floor is uneven, as is often the case in restrooms (which tend to have floors slanting downward toward a drainage system). Additionally, in some embodiments, the Stabilization Base 106 may be compressible to allow the Foot Controlled Elevator Device 100 to fit into narrow spaces. This is especially useful in restrooms, where the Divider Panel 101 may be positioned between toilets. This compressibility may be achieved through a spring-loaded mechanism, a pin, using a compressible material for the Stabilization Base 106, or any other such means.

The Vertical Height Actuator 104 sits on top of or is proximate to the Center Support Platform 106*b*. The Vertical Height Actuator 104 may be hydraulic, a screw ratchet, or a lever. In some embodiments, the Vertical Height Actuator 104 may include an electric power source, such as a motor driving a lift or a pump providing hydraulic pressure. Other embodiments include a foot pump providing hydraulic or rack and pinion or scissor jack action thereby providing elevation. The Vertical Height Actuator 104 is controlled by the Vertical Height Control 105, which comprises a foot pedal. In some embodiments, the Vertical Height Control 105 further comprises a back brace, to assist in user safety. In the initial, compressed position of the Vertical Height Actuator 104, the Vertical Height Control 105 may sit roughly level with a Saddle 107. A mechanic or other user wishing to engage the Vertical Height Actuator 104 may simply push down on the Vertical Height Control 105.

The Saddle 107 sits on top of the Vertical Height Actuator 104 to provide a cushion, support, and a contact point for the Divider Panel 101. In some embodiments, the Saddle 107 may comprise a Saddle Base 107A and Saddle Support 107B. The Saddle Base 107A sits on top of the Vertical Height Actuator 104 and provides a contact between the Vertical Height Actuator 104 and the object to be moved (such as the Divider Panel 101 in FIG. 1). The Saddle Support 107B may be adjustable through a spring-loaded mechanism. Additionally, the Saddle Support 107B may further comprise a small magnetic component 111 to assist in aligning with magnetic pieces proximate to the Wall Support 103 and within the corresponding wall. In some embodiments, one or more of the Saddle Base 107A or Saddle Support 107B may comprise features to stabilize the traction of the Divider Panel 101. For example, one or more of the Saddle Base 107A or Saddle Support 107B may comprise rubber, carpet, felt, or other scratchproof piece 108 that stops the Divider Panel 101 from sliding, especially if the Divider Panel 101 comprises metallic components.

Once the Vertical Height Control 105 has been engaged, the Vertical Height Actuator 104 may decompress, moving the Saddle 107 in a direction to provide upwards force roughly parallel to the Wall Support 103 and Vertical Support 102. Once the Saddle 107 contacts the Divider Panel 101, the Divider Panel 101 may move upward until it reaches the desired height, or until the Vertical Height Actuator 104 fully decompresses or extends. In some embodiments, the Divider Panel 101 may be placed on the Saddle 107 prior to positioning the Foot Controlled Elevator Device 100 in the desired position. The Foot Controlled Elevator Device 100 may then, in some embodiments, be rolled on wheels or other movement mechanism to the desired position. Additionally, in some embodiments, the Foot Controlled Elevator Device may further comprise a photometer or other device capable of detecting lasers.

Figure 3:
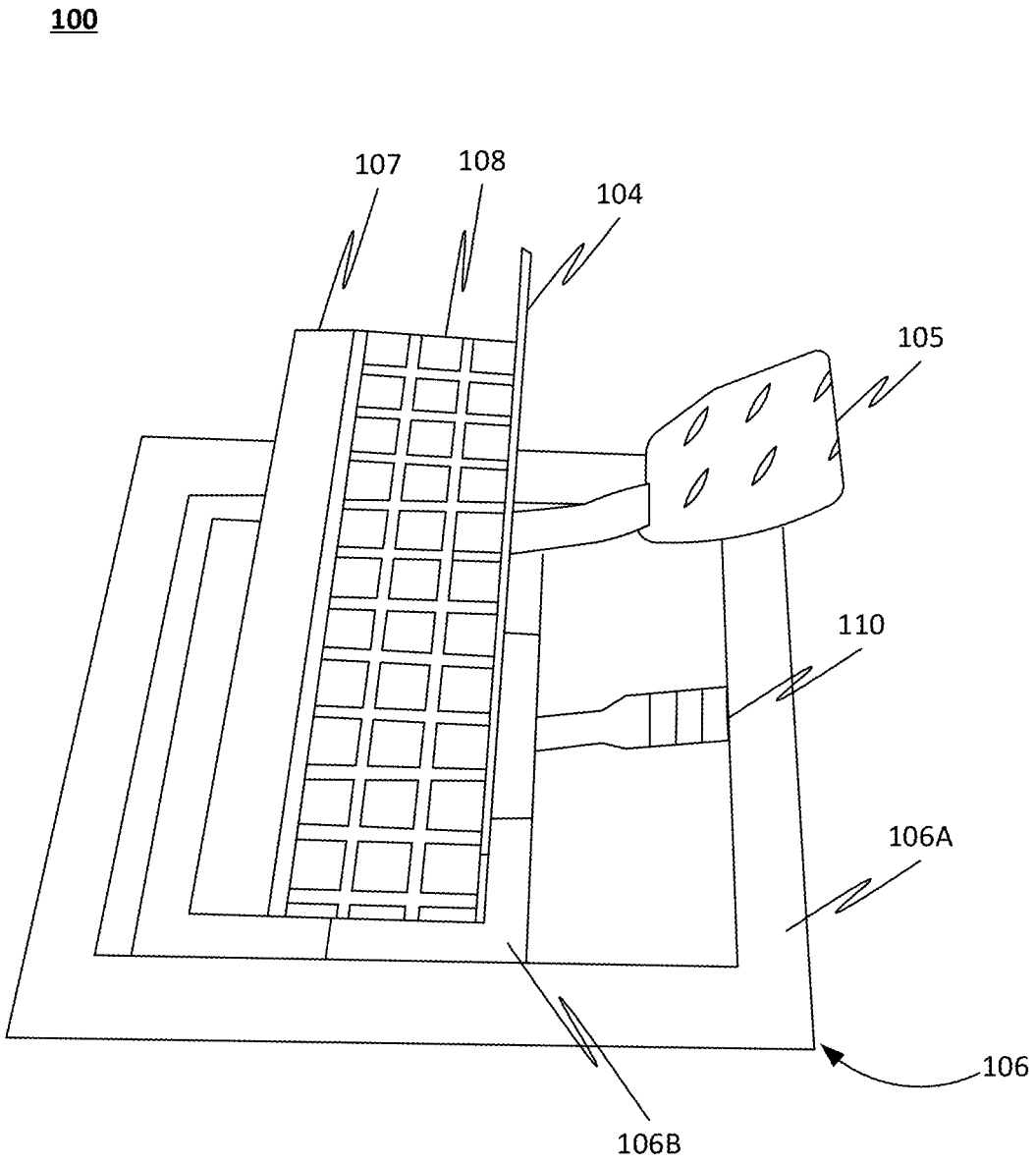
FIG. 3 illustrates a top-down view of an exemplary embodiment of the Foot Controlled Elevator Device.

Referring now to FIG. 3, a top-down view of an exemplary embodiment of the Foot Controlled Elevator Device 100 is shown. In some embodiments, Elevation Release 110 is fixed releasably to the Vertical Height Actuator 104. In other embodiments, Elevation Release 110 may be fixed releasably to the Center Support Platform 106*b*. The Elevation Release 110 assists in decompressing or de-extending the Vertical Height Actuator 104 and, consequently, Saddle 107. The Elevation Release 110 may comprise one or more of: a hydraulic valve release, a ratchet down, an electric screw, or an electric rack and pinion.

Figure 4:
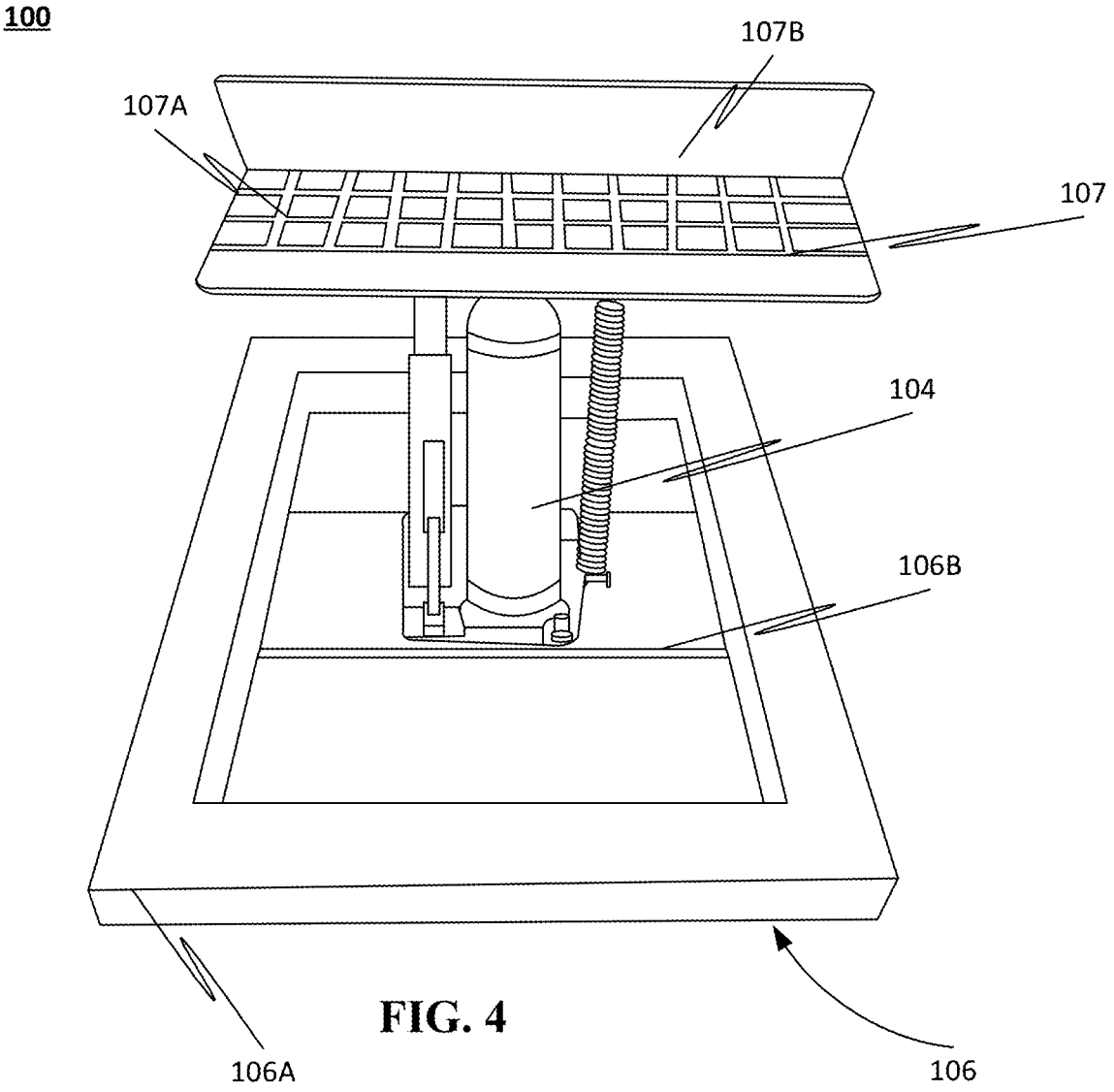
FIG. 4 illustrates a side view of an exemplary embodiment of the Foot Controlled Elevator Device.

FIG. 4 shows an alternative view of an exemplary embodiment of the Foot Controlled Elevator Device 100.

Figure 5:
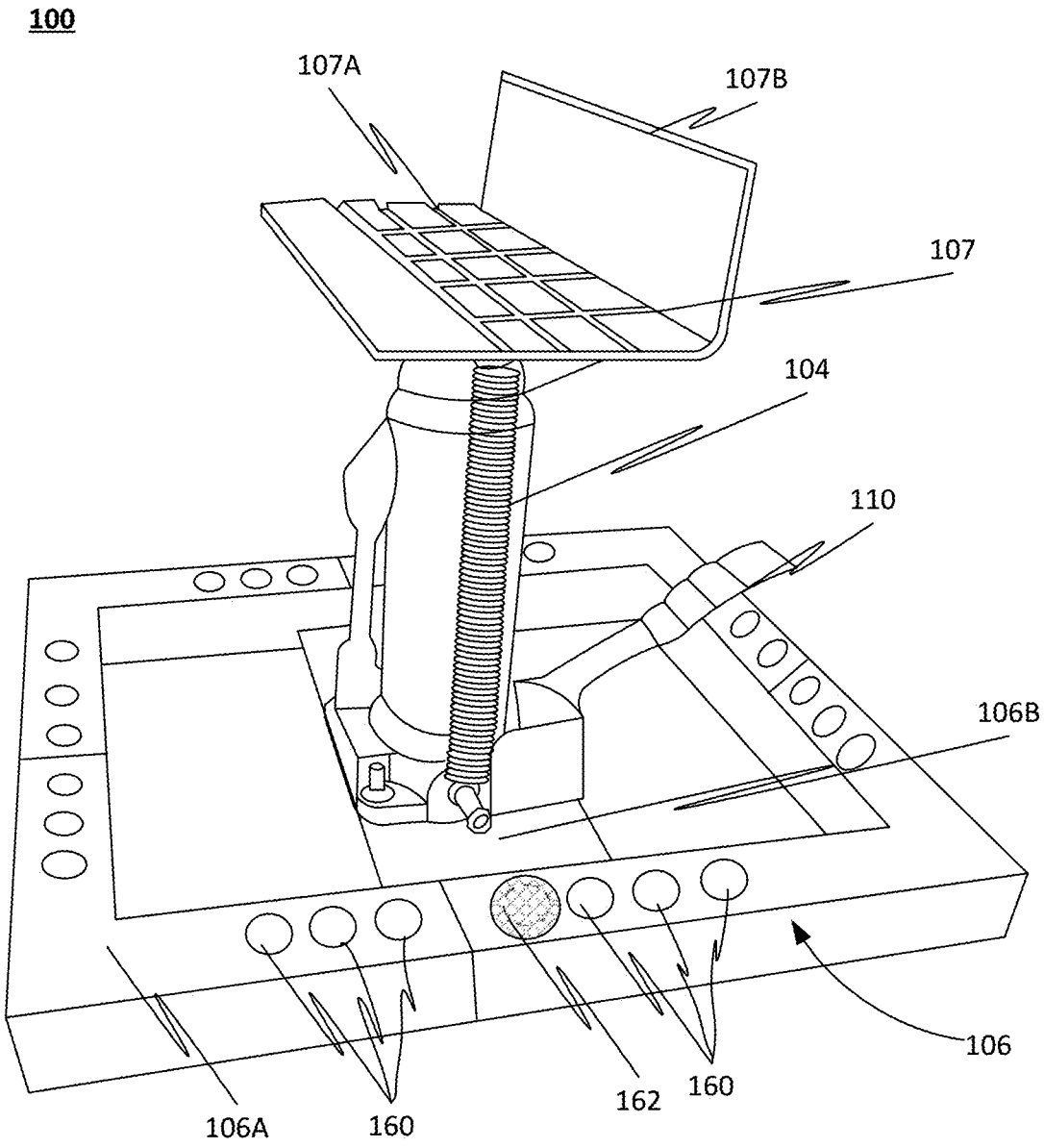
FIG. 5 illustrates an alternative side view of an exemplary embodiment of the Foot Controlled Elevator Device.

Referring now to FIG. 5, an exemplary, alternative embodiment of the Foot Controlled Elevator Device 100 is shown. In some embodiments, the Stabilization Base 106 may have one or more Adjustment Holes 160. These Adjustment Holes may be placed along one or more portions of the Perimeter Frame 106A, and may or may not be placed symmetrically. The size of the Perimeter Frame 106A may be adjusted by sliding a smaller part of the Perimeter Frame into a larger part, and locking the position of the Perimeter Frame 106A in place by inserting an Adjustment Peg 162 into the corresponding Adjustment Hole 160. In some embodiments, the Adjustment Peg 162 may comprise a clevis pin.

Figure 6:
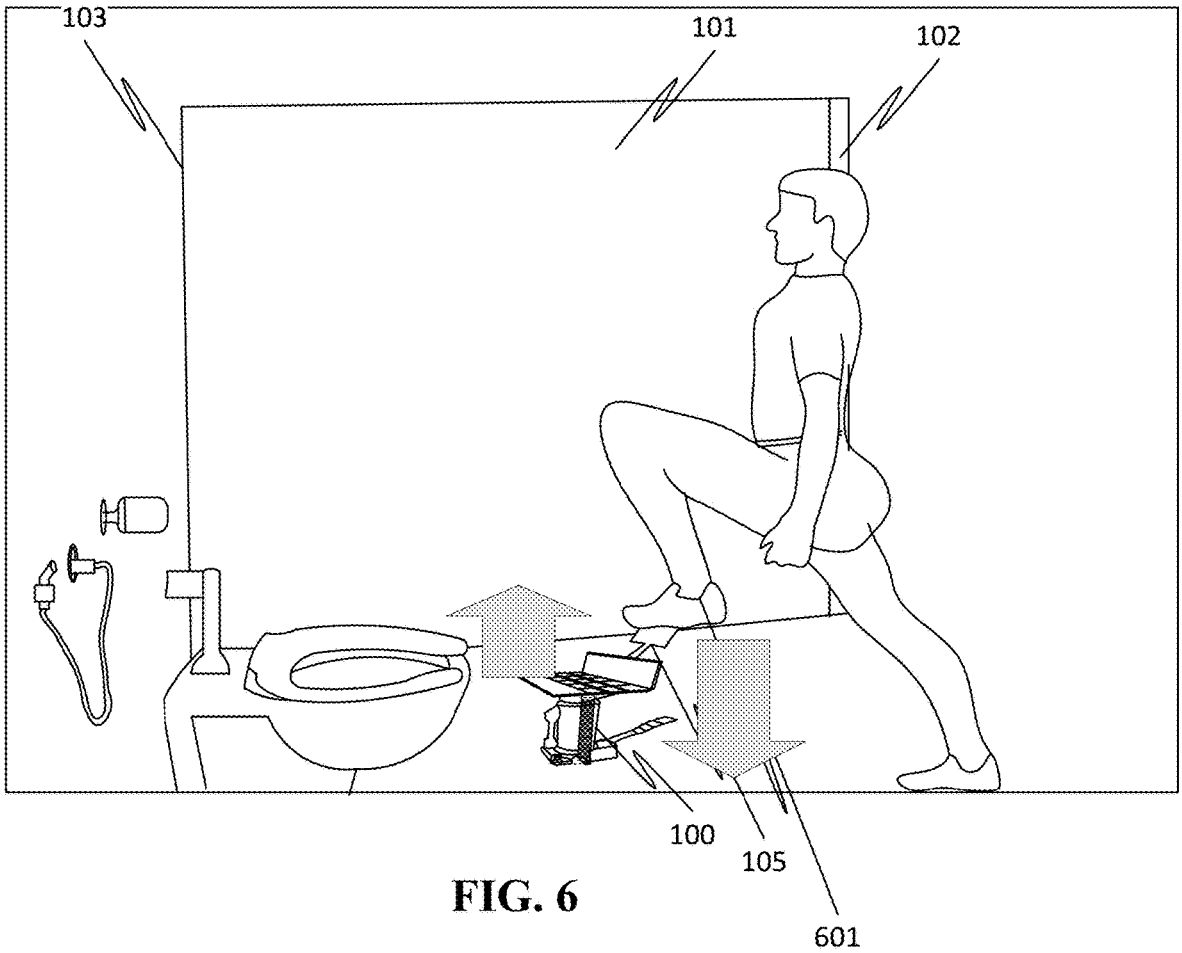
FIG. 6 illustrates an exemplary embodiment of the method of using the Foot Controlled Elevator Device.

Referring now to FIG. 6, an exemplary embodiment of the method for using the Foot Controlled Elevator Device 100 is shown. The user simply places his foot 601 on the Vertical Height Control 105 and applies a downward force to drive the object to be extended (here, the Divider Panel 101) upwards.

Figure 7:
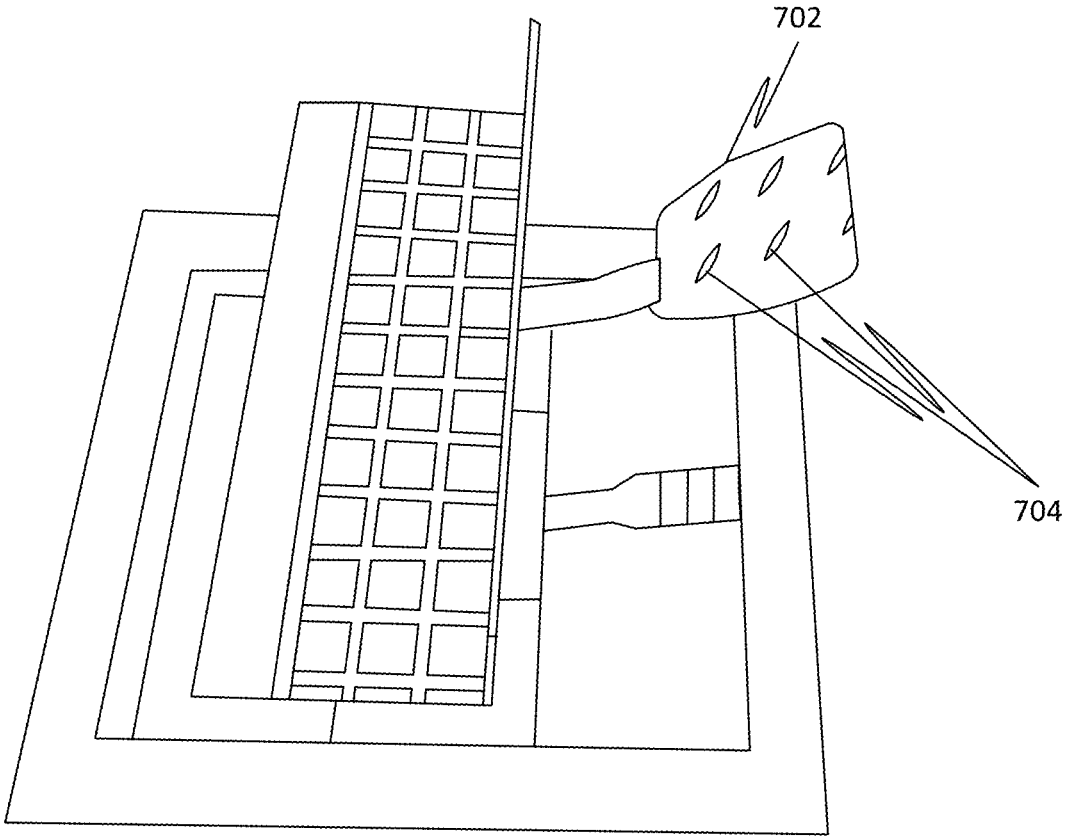
FIG. 7 illustrates an alternative embodiment of the Foot Controlled Elevator Device with improved safety features.

Referring now to FIG. 7, an alternative embodiment of the Foot Controlled Elevator Device 700 is shown. The difference between Foot Controlled Elevator Device 700 and Foot Controlled Elevator Device 100 is the addition of safety features. Due to the necessity of a user extending his leg, and potentially endangering his balance, Vertical Height Control 702 has one or more Traction Features 704 to provide a tactile surface on which the user may rest his foot. The traction features 704 provide amore certain interface between a user's foot and Vertical Height Control 702.

Figure 8:
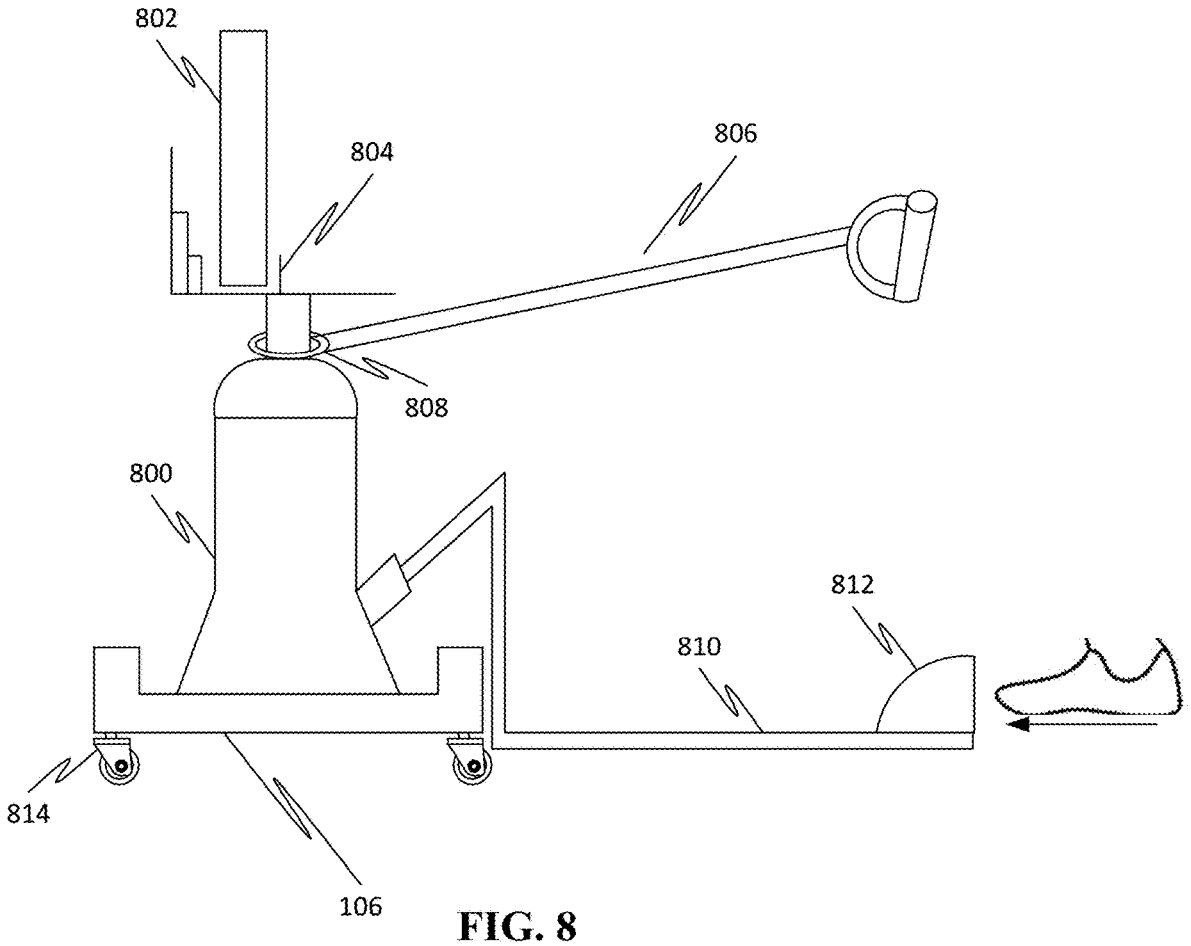
FIG. 8 illustrates an alternative embodiment of the Foot Controlled Elevator Device that does not require the leg extension contemplated in the embodiment shown in FIGS. 1-6.

Referring now to FIG. 8, an alternate embodiment of the Foot Controlled Elevator Device 100 is shown. In this embodiment, the Balance Vertical Height Control 812 is positioned at the distal end of extended elevation control 810. The extended elevation control allows for a user to remain more stable by positioning the control under the body mass of the user and improving the user's balance during use. Like Vertical Height Control 105 in FIG. 1, the Balance Vertical Height Control 812 may comprise a foot pedal. Unlike Vertical Height Control 105 in FIG. 1, Balance Vertical Height Control 812 is much lower to the ground. This prevents a user from needing to lift his leg high up off the ground to engage with the Vertical Height Control 105, thus providing additional balance. In some embodiments, the Balance Vertical Height Control 812 may further comprise a back brace for additional support for the user. In addition, the Balance Rod 810 adds additional length to the Foot Controlled Elevator Device, thus allowing a user to lift a more remote Divider Panel 101. The extended elevation control 810 may be a rod that may be static or compressible that creates distance between and connects the Balance Vertical Height Control 812 with the Vertical Height Actuator 800. The extended elevation control 810 may be compressed to a length between approximately three inches and six inches. In some embodiments, this compression may be achieved with a clevis pin or a ratchet. The Balance Vertical Height Control 812 may further comprise a foothold, with a secondary foot pedal therein.

Additionally, a Balance Assist Apparatus 806 is provided. The Balance Assist Apparatus 806 may comprise a rope connected to the Foot Controlled Elevator Device 100 on one end at 808, with a handle on the distal end. In some embodiments, the Balance Assist Apparatus 806 may also serve as an Elevation Release.

In some embodiments, the Stabilization Base 105 may have Wheels 814 affixed thereto. The remainder of the apparatus functions similarly to that described in FIG. 1. When activated, the Vertical Height Actuator 800 moves the Saddle 804 up, displacing Divider 802. The Saddle 804 sits on top of the Vertical Height Actuator 800.

Figure 9:
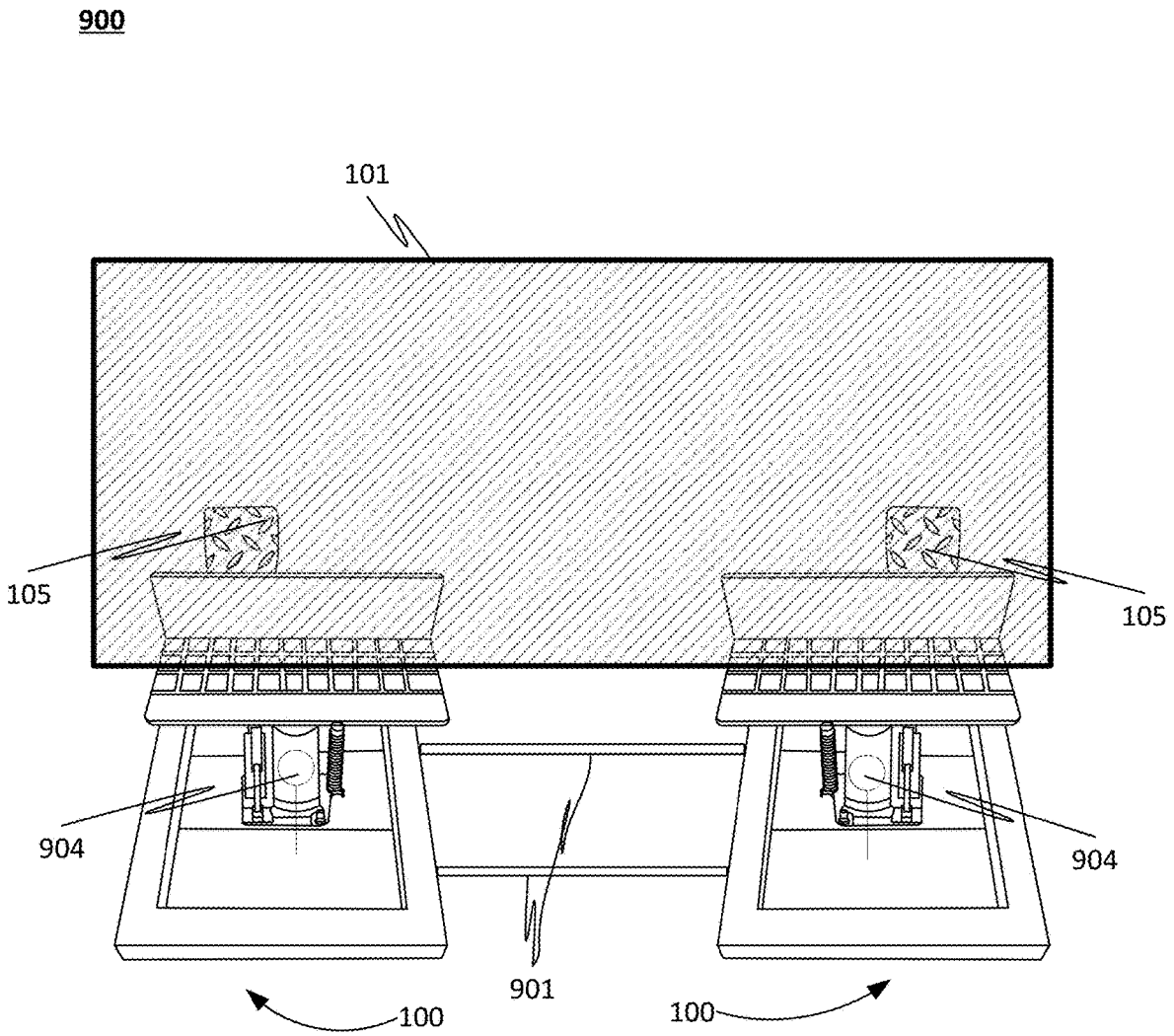
FIG. 9 illustrates an exemplary embodiment of the Combined Foot Controlled Elevator Device.

Referring now to FIG. 9, a Combined Foot Controlled Elevator Apparatus 900 is shown. A plurality of Foot Controlled Elevator Devices 100 may be controlled in conjunction with each other to simplify the process of positioning a Panel Divider 101. Such a plurality of Foot Controlled Elevator Devices 100 may be controlled in conjunction with each other may be referred to as "chained" together. Each chained Foot Controlled Elevator Devices 100 may be individually controlled to adjust a height of a portion of an item being lifted or simultaneously controlled to adjust a height of two or more Foot Controlled Elevator Devices 100 during a given time period. It is also within the scope of the present invention to adjust the height of a single panel or other item, or multiple panels or items during a same time period.

The Foot Controlled Elevator Devices 100 may be connected by one or more Pairing Control Rods 901 that may connect the Stabilization Base of one or more Foot Controlled Elevator Devices 100 with the Stabilization Base of one or more other Foot Controlled Elevator Devices 100. A Pairing Control Rod 901 may comprise a rigid or flexible tube, through which may run electrical wires or hydraulic fluid. In some embodiments, a Pairing Control Rod 901 may further comprise a valve. In some embodiments, a Pairing Control Rod 901 may be adjustable, such as by a clevis pin or ratchet. In some embodiments, a Switch 904 may be located on one or more of the Foot Controlled Elevator Devices 100. A Switch 904 may include one or more of: a button switch, a toggle switch, a spring loaded switch, a joy con, CCD device or other type of control.

Once activated, the Switch 904 allows a user to control a plurality of the Foot Controlled Elevator Devices 100 simultaneously using a smaller number of Vertical Height Controls 105. In some embodiments, one or more of the Foot Controlled Elevator Devices 100 may further comprise a level. This combined apparatus may be useful where the floor is not level, as is the case in many restrooms. This may also be useful when installing piano hinge doors.

Figure 10:
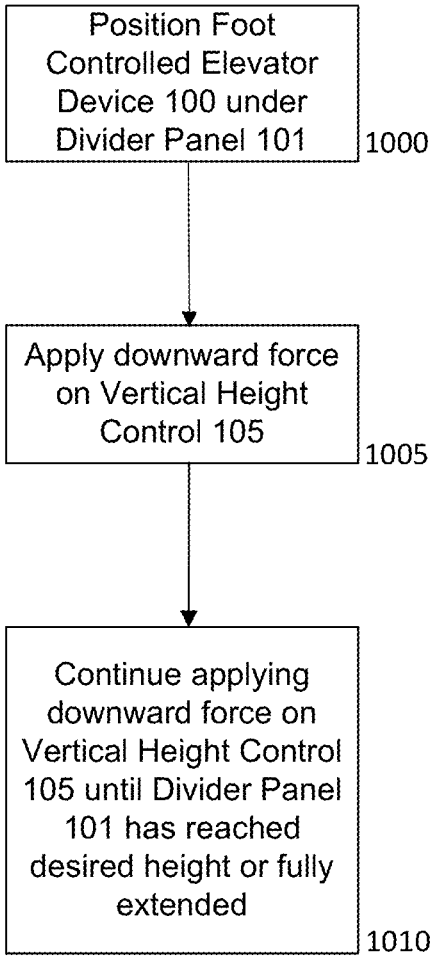
FIG. 10 illustrates a method of using the Foot Controlled Elevator Device.

Referring now to FIG. 10, method steps for using the Foot Controlled Elevator Device 100 are shown. At 1000, the Foot Controlled Elevator Device is positioned under Divider Panel 101. At 1005, a user applies downward force on the Vertical Height Control 105. At 1010, this downward force is continued to be applied on Vertical Height Control 105 until Divider Panel 101 has reached desired height or the Vertical Height Actuator 104 has fully extended or decompressed.

Figure 11:
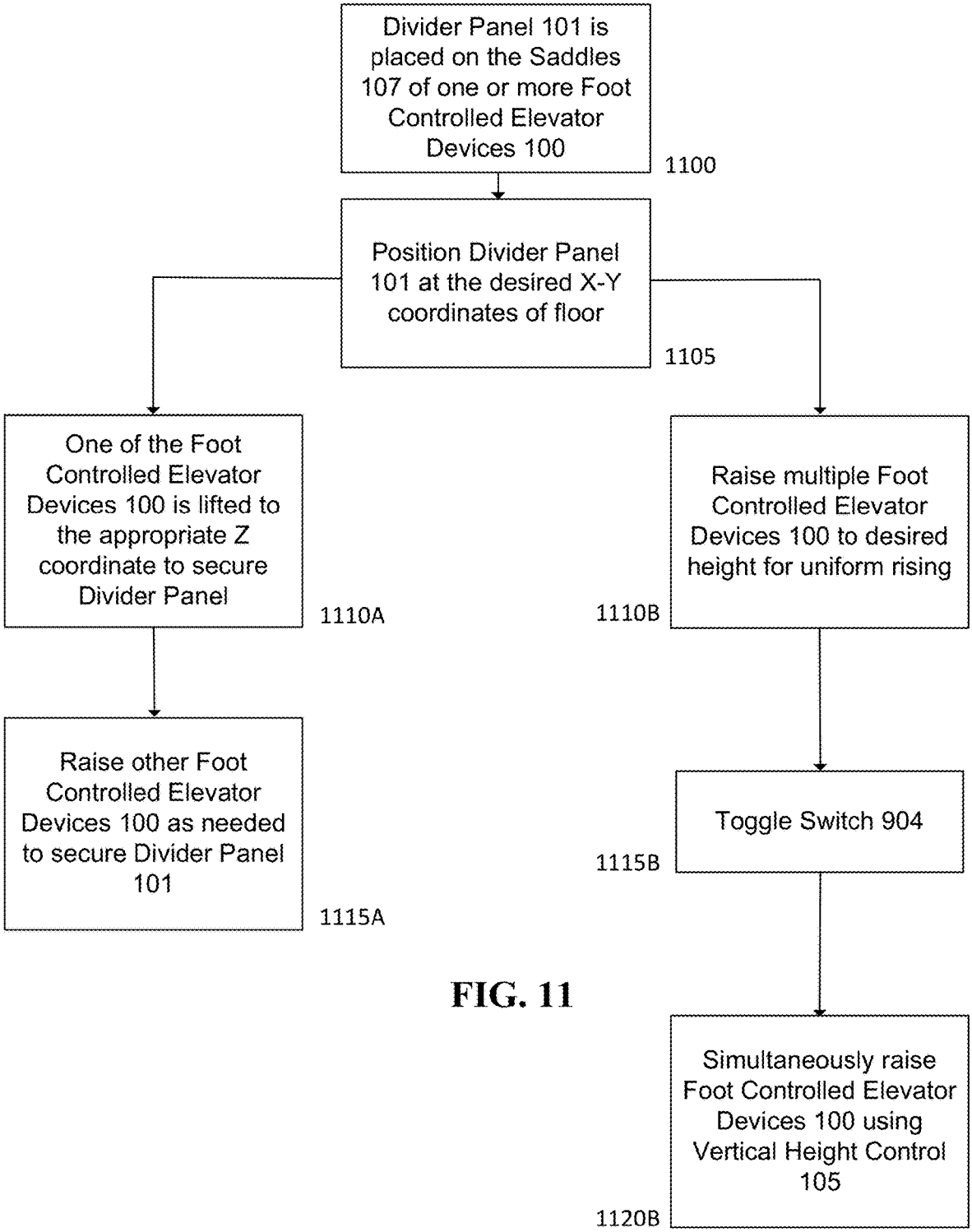
FIG. 11 illustrates a method of using the Combined Foot Controlled Elevator Device.

Referring now to FIG. 11, method steps for using the Combined Foot Controlled Elevator Device 900 are shown. At 1100, a Divider Panel 101 is placed on the Saddles 107 of each Foot Controlled Elevator Device 100. At 1105, the user may use a reference point, such as the high point of a restroom floor, to position the Divider Panel 101 at the desired X-Y point in the Cartesian plane formed by the floor of the restroom. At least two divergent paths are possible from this point. At 1110A, one of the Foot Controlled Elevator Devices 100 is lifted to the appropriate height (Z-coordinate) using the Vertical Height Control 105. For example, the Foot Controlled Elevator Device 100 closest to the Wall Support 103 may be raised to allow the user to secure a Divider Panel 101 to the Wall Support 103 before, at 1115A, raising the opposite side of the Divider Panel 101 to the appropriate height for securing to Vertical Support 102. This may provide additional stability for securing the Divider Panel 101. If there are multiple Foot Controlled Elevator Devices 100 comprising the Combined Foot Controlled Elevator Device 900, then step 1115A is repeated. In some embodiments, if one or more of the Foot Controlled Elevator Devices 100 comprises wheels, one or more sets of one or more of the wheels may decompress as one of the Foot Controlled Elevator Devices 100 rises, thus bringing the corresponding Foot Controlled Elevator Device(s) 100 closer to the ground. This enhances stability as well.

Alternatively, at 1110B, one or more of the Foot Controlled Elevator Devices 100 may be raised using the Vertical Height Control 105 until the one or more Foot Controlled Elevator Devices 100 reaches a desired height. For example, if a restroom floor is uneven (as many are); a first Foot Controlled Elevator Device 100 closest to the Wall Support 103 may be have a higher Z-coordinate than a second Foot Controlled Elevator Device 100 closer to the Vertical Support 102. Accordingly, it may be desirable to raise the second Foot Controlled Elevator Device 100 to a height level with the first Foot Controlled Elevator Device 100. However, step 1110B should not be construed to require such a height adjustment. It may be that the "desired height" is the initial height.

At 1115B, the Switch 904 is toggled. The Switch 904 enables simultaneous control of all Foot Controlled Elevator Devices 100 across the Combined Foot Controlled elevator Device 900 using only one of the Vertical Height Controls 105 on one of the Foot Controlled Elevator Devices.

At 1120B, downward force is applied to the controlling Vertical Height Control 105 until either the Divider Panel 101 reaches the desired height, or the Vertical Height Actuators 104 fully extend or decompress.

Conclusion

A number of embodiments of the present disclosure have been described. While this specification contains many specific implementation details, there should not be construed as limitations on the scope of any disclosures or of what may be claimed, but rather as descriptions of features specific to particular embodiments of the present disclosure. While embodiments of the present disclosure are described herein by way of example using several illustrative drawings, those skilled in the art will recognize the present disclosure is not limited to the embodiments or drawings described. It should be understood the drawings and the detailed description thereto are not intended to limit the present disclosure to the form disclosed, but to the contrary, the present disclosure is to cover all modification, equivalents and alternatives falling within the spirit and scope of embodiments of the present disclosure as defined by the appended claims.

In particular, although the present disclosure is explicitly directed to adjusting restroom stall dividers, it should not be limited to such dividers and may instead apply to a variety of partitions situated above the ground.

The headings used herein are for organizational purposes only and are not meant to be used to limit the scope of the description or the claims. As used throughout this application, the word "may" is used in a permissive sense (i.e., meaning having the potential to), rather than the mandatory sense (i.e., meaning must). Similarly, the words "include", "including", and "includes" mean including but not limited to. To facilitate understanding, like reference numerals have been used, where possible, to designate like elements common to the figures.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted the terms "comprising", "including", and "having" can be used interchangeably.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while method steps may be depicted in the drawings in a particular order, this should not be understood as requiring that such operations be performed in the particular order shown or in a sequential order, or that all illustrated operations be performed, to achieve desirable results.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A foot-controlled stall divider elevator device comprising:

a stabilization base comprising a rigid structure with a perimeter frame surrounding a center support platform and an anti skid characteristic comprising wheels and a braking system, the stabilization base stabilizing the foot-controlled stall divider elevator device on a floor;

a vertical height actuator coupled to a top portion of the stabilization base;

a vertical height controller coupled to the vertical height actuator and capable of adjusting the height of the vertical height actuator relative to the stabilization base;

a saddle for receiving a restroom stall divider comprising a divider panel, a wall support and a vertical support, said saddle coupled to a top of the vertical height actuator and comprising a saddle base, a vertical saddle support and a magnetic component and planar dimensions capable of supporting the restroom stall divider panel in a vertical position, and a rubber portion on the saddle that stops the divider panel from sliding on the saddle for receiving the stall divider.

2. The foot-controlled elevator device of claim 1, additionally comprising a photometer capable of detecting a laser.

3. The foot-controlled elevator device of claim 1, wherein the vertical height control comprises a pedal, the vertical height actuator comprises a hydraulic lift, and the pedal is operative to lift and lower the vertical height actuator.

4. The foot-controlled elevator device of claim 2, wherein the perimeter frame comprises an inner frame, an outer frame comprising an opening larger than the size of a surface of the inner frame, one or more adjustment holes in each of the inner frame and the outer frame, and one or more adjustment pegs for setting a perimeter size by inserting the inner frame through the outer frame until the desired perimeter size is reached, and then placing the adjustment peg through aligned adjustment holes in the inner frame and the outer frame.

5. The foot-controlled elevator device of claim 4, wherein the alignment peg comprises a clevis pin.

6. The foot-controlled elevator device of claim 1, wherein the stabilization base comprises a flexible scissor structure.

7. The foot-controlled elevator device of claim 1, wherein the vertical height controller is in electrical communication with an electrical power source capable of driving a motor within the vertical height actuator.

8. The foot-controlled elevator device of claim 1, wherein the vertical height actuator further comprises a photometer.

9. A method of attaching a divider panel to a restroom wall, the method comprising the steps of:

placing the divider panel on a saddle of a foot-controlled elevator device, wherein the foot-controlled elevator device comprises: a stabilization base comprising a rigid structure with a perimeter frame surrounding a center support platform and an anti skid characteristic comprising wheels and a braking system, the stabilization base stabilizing the foot-controlled stall divider elevator device on a floor;

a vertical height actuator coupled to a top portion of the stabilization base;

a vertical height controller coupled to the vertical height actuator and capable of adjusting the height of the vertical height actuator relative to the stabilization base;

the saddle for receiving a restroom stall divider comprising the divider panel, a wall support and a vertical support, said saddle coupled to a top of the vertical height actuator and comprising a saddle base, a vertical saddle support and a magnetic component and planar dimensions capable of supporting the restroom stall divider panel in a vertical position, and a rubber portion on the saddle that stops the divider panel from sliding on the saddle for receiving the stall divider, using the vertical height controller, engaging the vertical height actuator to raise the divider panel to a height appropriate for attachment to a wall support attached to the restroom wall;

attaching the divider panel to the wall support; and using the vertical height controller, engaging the vertical height actuator to lower the saddle.

10. The method of claim 9, wherein the stabilization base comprises a scissor structure.

11. The method of claim 9, wherein the center support platform comprises the perimeter frame, which comprises an inner frame, an outer frame comprising an opening larger than the size of a surface of the inner frame, one or more adjustment holes in each of the inner frame and the outer frame, and one or more adjustment pegs for setting a perimeter size by inserting the inner frame through the outer frame until the desired perimeter size is reached, and then placing the adjustment peg through aligned adjustment holes in the inner frame and the outer frame.

* * * * *